US006652116B2

(12) United States Patent
Dickinson

(10) Patent No.: US 6,652,116 B2
(45) Date of Patent: Nov. 25, 2003

(54) FLASHLIGHT WITH A SPARE BATTERY HOLDER

(76) Inventor: Benjamin Signorino Dickinson, 2912 Plaza Dr., Chalmette, LA (US) 70043-3536

( * ) Notice: Subject to any disclaimer, the term of this patent is extended or adjusted under 35 U.S.C. 154(b) by 14 days.

(21) Appl. No.: 10/050,072

(22) Filed: Jan. 17, 2002

(65) Prior Publication Data

US 2003/0133290 A1 Jul. 17, 2003

(51) Int. Cl.[7] ..... F21L 4/04

(52) U.S. Cl. ..... 362/202; 362/157; 362/205; 362/183; 362/194; 362/171; 362/207; 362/198

(58) Field of Search ..... 362/202, 157, 362/205, 183, 207, 208, 194, 171, 198

(56) References Cited

U.S. PATENT DOCUMENTS 5,188,450 A * 2/1993 Anderson ..... 362/194
5,197,796 A * 3/1993 Moore ..... 362/202
5,758,949 A * 6/1998 Van Deursen ..... 362/186
6,305,820 B1 * 10/2001 Poon ..... 362/186

* cited by examiner

*Primary Examiner*—Sandra O'Shea
*Assistant Examiner*—Bertrand Zeade
(74) *Attorney, Agent, or Firm*—Keaty Professional Law Corporation

(57) ABSTRACT

A portable flashlight or lantern has a main body for housing a primary source of electrical power, such as batteries and a light bulb operationally connected to the batteries. A secondary housing is detachably secured on the main body for holding a spare set of batteries without electrically connecting the spare batteries to the light bulb. When the primary batteries are exhausted, the user disengages a coupler that holds the secondary housing and the main body together, removes the spare batteries and substitutes them for the old batteries.

16 Claims, 1 Drawing Sheet

FLASHLIGHT WITH A SPARE BATTERY HOLDER

BACKGROUND OF THE INVENTION

This invention relates to hand-held tools and, more particularly, to a portable illumination device such as a lantern, flashlight and the like.

Portable illumination devices are widely used by people in a variety of industries; in the homes, while camping and for numerous other activities. Flashlights in particular are extensively used as convenient small-sized devices that can be secured on a belt of a worker or stored in a toolbox, back pack, etc. The small size of portable lanterns and flashlights makes them ideal for use in remote places where municipal electrical power is not available, or where an electrical cable is impractical. Flashlights and lanterns are manufactured in a variety of sizes; they may have plastic or metal housings; different power light bulbs and lenses.

Most of the portable illumination devices operate on rechargeable or disposable batteries that are positioned in the housing to provide a power source for a single light bulb mounted behind a lens. The batteries have a relatively short life; they need to be regularly changed if the flashlight is used on a regular basis. Conventional flashlights may use two or more AA size batters, C size batteries, etc. When the battery life expires, the battery has to be either recharged, if it is a rechargeable battery, or has to be thrown away and new batteries installed. Oftentimes, the user finds him in a location where spare batteries are not available. Once the battery stops operating, the flashlight becomes useless. If the user did not provide for a supply of fresh batteries, he finds himself "in the dark" unable to continue with the tasks he set out to do.

The present invention contemplates elimination of drawbacks associated with the prior art and provision of a flashlight with a holder for spare batteries to be used with flashlights, lanterns, and other portable illumination devices.

SUMMARY OF THE INVENTION

It is, therefore, an object of the present invention to provide a flashlight and similar illumination device with a holder for spare batteries.

It is another object of the present invention to provide a holder for spare batteries that can be easily secured on conventional flashlight housings.

It is a further object of the present invention to provide an attachment for a conventional flashlight for housing spare batteries that is easy to use and inexpensive to manufacture.

These and other objects of the present invention are achieved through a provision of a flashlight that has a housing for retaining a primary power source and an illumination members, such as a light bulb, electrically connected to the primary power source. A secondary housing is detachably secured on the main housing; the secondary housing retaining a secondary, substitute power source for placing in the primary housing after the primary power source has expired. The secondary housing is secured co-extensively with the primary housing, serving as an elongated handle for the primary housing.

The secondary housing is positioned in a telescopic engagement with a closed end of the primary housing, the end that does not carry the illumination member. A threaded coupler is engaged with the secondary housing and covers the area of connection between the secondary housing and the primary housing.

When the primary power source, such as batteries in the main housing, are used up, the user disengages the coupler from the secondary housing, takes out the spare batteries and places them in the primary housing. The used-up batteries may be then stored in the secondary housing when an opportunity presents itself for recharging the batteries or disposing them in an environmentally safe manner.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
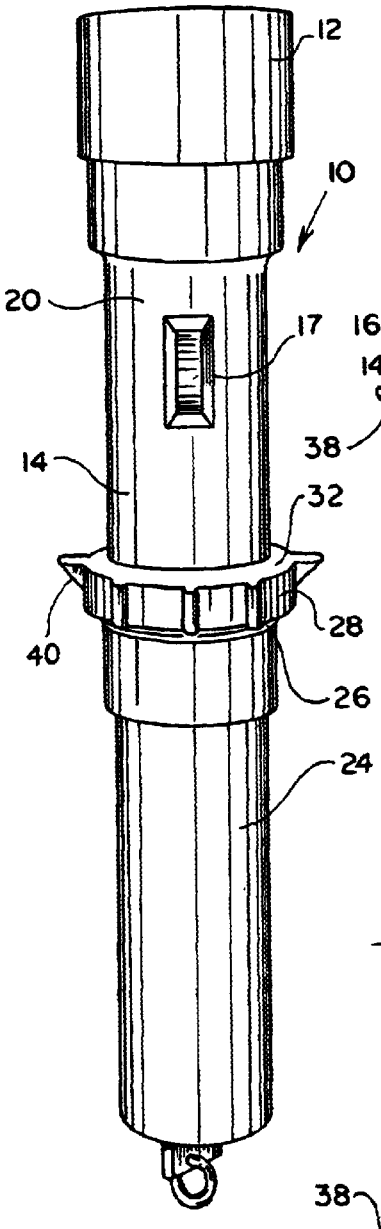
FIG. 1 is a side view of the flashlight with a holder for extra batteries in accordance with the present invention.
Figure 2:
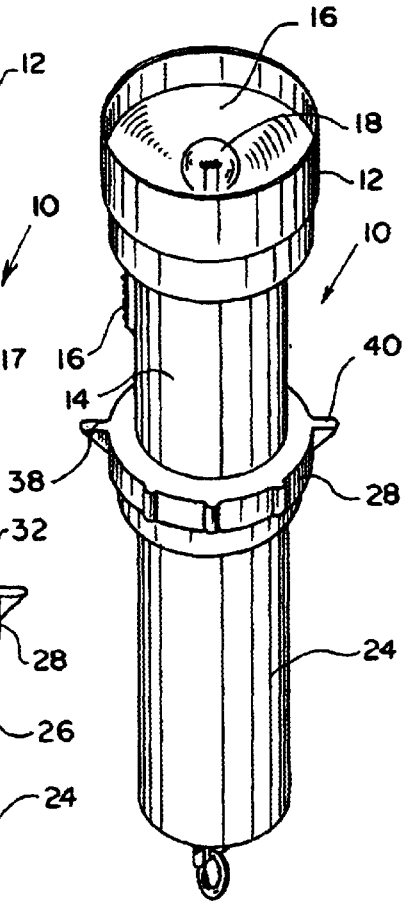
FIG. 2 is a perspective view of the flashlight in accordance with the present invention.

Turning now to the drawings in more detail, numeral 10 designates a flashlight having a first end portion 12, a second end portion 14, and a switch 16 for activating the flashlight. The first end portion 12 is a hollow cylindrical portion having a lens 16 covering the open-end portion 12. A light bulb 18 is mounted under the lens 16 for providing illumination in a desired location.

A switch 17 activates the electrical circuit (not shown) connecting the light bulb 18 to primary power source, or batteries (not shown) positioned in the main housing 20 of the flashlight 10. The flashlight 10 can be of any conventional design, with a switch 17 moving up and down along the longitudinal axis of the body 20 for closing the electrical circuit and establishing the connection between the light bulb 18 and the power source, which can be batteries, located in the body 20.

Figure 4:
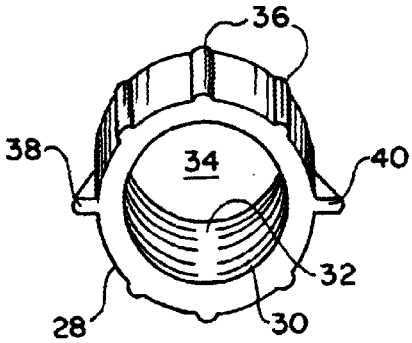
FIG. 4 is a detail perspective view of a coupler for use with the device of the present invention.

The lower portion 14 of the housing 20 fits into an upper portion 22 of the holder 24. The portion 22 is provided with external threads 26 in the uppermost portion thereof. A threaded coupler 28 secures the secondary housing, or holder 24 to the main body, or housing 20. As can be better seen in FIG. 4, the coupler 28 is provided with internal threads 30 in the lower portion thereof.

The coupler 28 is provided with an inwardly extending flange 32; the flange 32 has an opening 34 of a diameter slightly greater than an external diameter of the second portion 14 of the housing 20. When the coupler 28 is positioned on the holder 24, the flange 32 frictionally contacts the exterior wall of the housing body 20. The coupler 28 covers the area of the telescopic connection of the holder 24 and the main body 20, securely attaching the holder 24 to the main body 20.

The exterior surface of the coupler 28 has with a plurality of outwardly extending cross ridges 36 to allow gripping of the coupler 28 and rotation thereof. A pair of tabs 38 and 40 are unitary connected to the coupler ring and extend outwardly to further facilitate gripping of the coupler 28 and rotation thereof when connecting the holder 24 to the flashlight body 20. When the holder 24 and the main body 20 are connected, the holder 24 serves as an extension of the body 20, extending the handle of the flashlight or lantern, as the case may be. The longitudinal axis of the holder 24 and the main body 20 are generally co-axial, which allows to conveniently distribute the weight of the extra batteries retained n the holder 24.

Figure 3:
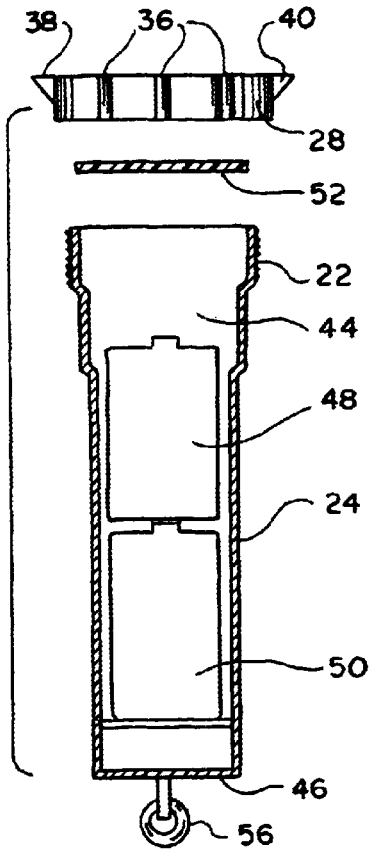
FIG. 3 is a cross-sectional, exploded view of the extra battery holder in accordance with the present invention.

As can be seen in FIG. 3, the holder 24 is a hollow housing having an inner chamber 44 extending from the top 22 to the bottom wall 46 thereof. The chamber 44 is configured to receive two or more spare batteries 48 and 50 that can be positioned end-to-end within the chamber 44. The batteries 48 and 50, while retained in the holder 24 are not operationally connected to the light bulb 18.

A compression ring 52 is provided for engagement with the interior of the coupler 28 when the holder 24 is secured to the flashlight body 20. The compressing ring 52 fits against the flange 32 and, being made from a flexible, resilient material, slightly compresses, allowing to tighten the coupler 28 about the body 20 and the portion 22 of the holder 24. The ring 52 allows sealing of the interior of the holder 24 and preventing moisture from penetrating into the cavity 44.

The lower portion 14 of the body 20 has no threads. Through provision of the coupler 28, with a compression ring 52, the user is able to secure the holder 24 on the body 20 without any modifications to the standard housing of the conventional flashlight.

The holder 24 forms an independent compartment not electrically connected to the main circuitry within the flashlight body 20. The batteries 48 and 50 are kept in a weatherproof environment. No drain of power from the batteries 48 and 50 occurs while they are positioned in the cavity 44. At the same time, the spare batteries are available for use when the main batteries within the body 20 expire. The bottom wall 46 of the holder 24 has a securing ring 56 to allow suspending of the flashlight 10 with the holder 24 attached thereto, from a nail or a belt carried by the user.

In operation, the user places spare batteries 48 and 50 into the cavity 44 and moves the holder 44 into a telescopic engagement with the lower portion 14 of the body 20. The hollow portion 22 of the holder 24 has an internal diameter slightly greater than the exterior wall diameter of the portion 14 of the body 20. The user then slides the coupler 28 from the lower portion 46 of the holder 24 upward until it reaches the area of connection between the portion 14 of the main body 20 and the portion 22 of the holder 24. The user then rotates the coupler 28 engaging the threads 26 on the portion 24 with the threads of the coupler 28. The compression ring 52 is slightly compressed against the flange 32. The holder 24 is now securely connected to the body 20.

When the spare batteries 48 and 50 are needed, the user reverses the rotation of the coupler 28 to disengage the coupler 28 from the threads 26 on the holder 24. The coupler 28 slides downwardly, allowing the user to slightly pull on the holder 24 and disengage it from the telescopic connection around the portion 14 of the body 20. The user then turns the holder 24 upside down, allowing the batteries 48 and 50 to slide out of the cavity 44 and substitutes the batteries for the batteries removed from the body 20. The old batteries can be placed within the holder 24 to be later recharged or disposed of in an environmentally safe manner.

The holder 24, the coupler 28 are made from durable lightweight, non-corrosive material, such as strong plastic, capable of withstanding impact of the holder with metal or other solid objects. The moisture-proof environment of the cavity 44 allows the batteries 48 and 50 to be retained in a moisture-free, protected environment until the batteries 48 and 50 are needed. If the holder 24 becomes cracked or damaged, it can be easily replaced with a similar holder without disposing of the more expensive flashlight body 20. The holder 24 provides for easy modification of a conventional flashlight, ensuring longer utility of the flashlight. The holder 24 can be configured to fit other portable illumination devices, such as lanterns operated on batteries by suitably modifying the holder body and having it configured to a different shape of the main housing.

Many other changes and modifications can be made in the design of the present invention without departing from the spirit thereof. I therefore pray that my rights to the present invention be limited only by the scope of the appended claims.

I claim:

1. A portable illumination device, comprising:

a main body for retaining a primary source of power and an illumination member operationally connected to the primary power source; and a secondary housing detachably securable on said main body, said secondary housing being configured to retain a secondary source of power without operationally connecting said secondary source of power to the illumination member, said secondary housing having an open end with a diameter at least slightly greater than a diameter of said main body to allow the secondary housing to telescopically engage about at least a portion of the main body.

2. The device at claim 1, wherein said secondary source of power replaces the primary source of power when the primary source of power is exhausted.

3. The device of claim 1, wherein said primary source of power is a battery, and said secondary source of power is a replacement battery.

4. The device of claim 1, wherein said secondary housing has an open end having a diameter at least slightly greater than a diameter of said main body to allow the secondary housing to telescopically engage about at least a portion of the main body.

5. The device of claim 1, further comprising a means for securing said secondary housing on the main body.

6. The device of claim 5, wherein said securing means comprises a threaded coupler provided with inner threads on at least a portion of an interior wall, said coupler configured to tighten about a line of connection of said secondary housing about the main body.

7. The device of claim 6, further comprising a compression member configured for positioning inside said coupler between said main body and said secondary housing to facilitate a sealed engagement between the main body and the secondary housing.

8. The device of claim 6, wherein said threaded coupler is provided with a pair of tabs unitary connected to an exterior wall of said coupler, said tabs facilitating gripping of said coupler and applying torque to said coupler when engaging said secondary housing to said main body.

9. A portable illumination device, comprising:

a main body for retaining a primary source of electrical power and an illumination member operationally connected to the primary electrical power source;

a secondary housing detachably securable on said main body configured to retain a secondary source of electrical power without operationally connecting said secondary source of electrical power to the illumination member, said secondary source of electrical power replacing said primary source of electrical power after the primary source of electrical power has been exhausted; and a means for detachably securing said secondary housing on said main body, said securing means comprising a coupler positionable over a line of connection between said main body and said secondary housing, said coupler configured to threadably engage said secondary housing after the secondary housing is telescopically engaged with the main body.

10. The device of claim 9, further comprising a compression member configured for positioning inside said coupler between said main body and said secondary housing to facilitate a sealed engagement between the main body and the secondary housing.

11. The device of claim 9, wherein said primary source of electrical power is a battery, and said secondary source of electrical power is a replacement battery.

12. A holder for retaining a replacement source of electrical power for a portable illumination device having a main body housing a primary power source and an illumination member electrically connected to said primary power source, the holder comprising:

a hollow body having a first open end and a second closed end, said first open end being configured to telescopically engage at least a portion of said main body, said hollow body defining a chamber for retaining the replacement source of electrical power; and a means for securing said hollow body with said main body.

13. The device of claim 12, wherein said first end of said hollow body is provided with external threads.

14. The device of claim 13, wherein said securing means comprises a coupler threadably engageable with said external threads of the hollow body and extending over a line of connection between said main body and said hollow body.

15. The device of claim 14, further comprising a flexible resilient compression member configured for positioning inside said coupler to facilitate a sealed engagement between the main body and the hollow body.

16. The device of claim 12, wherein said primary power source is a battery operationally connected to the illumination member, and said hollow body retains a replacement battery without electrically connecting said illumination member to said replacement battery.

* * * * *